US005866842A

United States Patent [19]

Wilson et al.

[11] Patent Number: 5,866,842

[45] **Date of Patent: *Feb. 2, 1999**

[54] LOW TEMPERATURE AUTOIGNITING PROPELLANT COMPOSITION

[75] Inventors: Kimberly A. Wilson, Seattle; Michael A. Wilson, Bothell; Donald R. Poole, South Colby; Gary F. Holland, Snohomish, all of Wash.

[73] Assignee: Primex Technologies, Inc., Redmond, Wash.

[ * ] Notice: This patent issued on a continued prosecution application filed under 37 CFR 1.53(d), and is subject to the twenty year patent term provisions of 35 U.S.C. 154(a)(2).

[21] Appl. No.: 683,286

[22] Filed: Jul. 18, 1996

[51] Int. Cl.[6] ..... C06B 45/10; C06B 35/00

[52] U.S. Cl. ..... 149/19.6; 149/19.91; 149/35; 149/46

[58] Field of Search ..... 149/19.4, 19.91, 149/19.6, 35, 46

[56] References Cited

U.S. PATENT DOCUMENTS

| | | | |
|---|---|---|---|
| 2,159,234 | 5/1939 | Taylor | 52/14 |
| 2,165,263 | 4/1939 | Holm | 102/12 |
| 2,558,756 | 7/1951 | Jackson et al. | 23/281 |
| 3,044,123 | 7/1962 | Grubaugh | 18/55 |
| 3,343,921 | 9/1967 | Braun | 23/281 |
| 3,719,604 | 3/1973 | Prior et al. | 252/186 |
| 3,739,574 | 6/1973 | Godfrey | 60/39.03 |
| 3,797,854 | 3/1974 | Poole et al. | 280/150 |
| 3,912,562 | 10/1975 | Garner | 149/41 |
| 3,954,528 | 5/1976 | Chang et al. | 149/19.4 |
| 4,300,962 | 11/1981 | Stinecipher et al. | 149/47 |
| 4,421,578 | 12/1983 | Voreck | 149/2 |
| 4,552,598 | 11/1985 | Lee et al. | 149/47 |
| 4,601,344 | 7/1986 | Reed et al. | 169/47 |
| 4,909,549 | 3/1990 | Poole et al. | 280/738 |
| 4,923,536 | 5/1990 | Canterberry et al. | 149/19.4 |
| 4,925,503 | 5/1990 | Canterberry et al. | 149/19.4 |
| 4,931,112 | 6/1990 | Wardle et al. | 149/88 |
| 4,944,528 | 7/1990 | Nilsson et al. | 280/741 |
| 5,035,757 | 7/1991 | Poole | 149/46 |
| 5,084,118 | 1/1992 | Poole | 149/22 |
| 5,098,683 | 3/1992 | Mehrotra et al. | 423/266 |
| 5,100,170 | 3/1992 | Mihm et al. | 280/735 |
| 5,125,684 | 6/1992 | Cartwright | 280/736 |
| 5,167,426 | 12/1992 | Mihm et al. | 280/735 |
| 5,380,380 | 1/1995 | Poole et al. | 149/22 |
| 5,429,386 | 7/1995 | Mihm et al. | 280/734 |
| 5,460,671 | 10/1995 | Khandhadia et al. | 149/109.6 |
| 5,468,313 | 11/1995 | Wallace, II et al. | 149/53 |
| 5,529,649 | 6/1996 | Lund et al. | 149/19.3 |
| 5,531,941 | 7/1996 | Poole | 264/3.4 |

FOREIGN PATENT DOCUMENTS

| | | |
|---|---|---|
| 851919 | 7/1949 | Germany . |
| 854770 | 7/1949 | Germany . |
| 909424 | 4/1954 | Germany . |
| WO 95/04710 | 2/1995 | WIPO . |

*Primary Examiner*—Peter A. Nelson
*Attorney, Agent, or Firm*—Todd E. Garabedian; Wiggin & Dana

[57] ABSTRACT

A low temperature autoigniting composition for use in a mobile occupant restraint system comprising, a low temperature melting oxidizer and a fuel, wherein the low temperature autoigniting composition autoignites in the temperature range of about 130° C. to about 175° C. In a preferred embodiment, the composition comprises a low temperature melting oxidizer, a fuel, and a catalyst, wherein the composition autoignites in the temperature range of about 130° C. to about 150° C. Preferably, the oxidizer comprises about 20 to about 70 percent by weight of the composition, the fuel comprises about 10 to about 50 percent by weight of the composition, and the catalyst comprises about 2 to about 50 percent by weight of the composition. The autoignition propellants of the invention are designed to function at low temperatures and before heat damage to an airbag deployment mechanism can occur, for example, during a fire.

9 Claims, No Drawings

LOW TEMPERATURE AUTOIGNITING PROPELLANT COMPOSITION

FIELD OF THE INVENTION

This invention relates to autoigniting propellants, and more particularly to low temperature autoigniting propellants useful in mobile occupant restraint systems.

BACKGROUND OF THE INVENTION

Most automobiles sold today incorporate an inflatable occupant restraint system (Supplemental Restraint System or SRS airbags). These systems are designed to be activated in the event of a frontal collision to protect the driver, and sometimes the front passenger, from injury. In a collision, the system is activated to inflate an airbag which restrains the occupants and protects them from the forces generated during the collision. In most instances, the method of deploying the bag includes electrical ignition of a gas-generating chemical, such as sodium azide, that quickly inflates the bag during the frontal impact.

Federal standards require that the inflating system used in automobile airbag restraint systems be designed to function during exposure to fire while maintaining inflator body integrity. This requirement is intended to protect nearby persons and property should the system be exposed to a fire while in the car, or when the device is uninstalled and being shipped. However, the casing containing the inflating mechanism may become weakened when exposed to the high heat of a fire. When the inflating system is activated under these conditions, the weakened casing may rupture and propulsively propel sharp pieces of the casing and very hot gases and particles. This situation creates the potential for injuring nearby persons, such as firefighters, or damage to nearby property.

One solution to overcome the problem of a weakened casing during exposure to fire is to formulate an activating propellant that ignites at a lower temperature than the temperature at which the casing is weakened. This solution integrates a special autoignition propellant which autoignites at a temperature that is lower than that of the main propellant. Once ignited, the autoigniting propellant lights the main propellant which inflates the airbag.

Several disadvantages occur with many typical autoignition propellants. First, many of the autoignition propellants autoignite at temperatures around 200° C. As the main propellant approaches this temperature (especially likely at low heating rates), the burning characteristics change to make combustion more rapid. This increased rate of propellant combustion increases the probability of deformation or damage to the inflator casing following ignition.

Another disadvantage of many autoignition propellants that autoignite at approximately 200° C. is the time required to transfer heat to the inside of the inflator where the autoignition propellant is located. The relatively long exposure time required to heat the autoignition propellant to its autoignition temperature causes the exterior of the inflator casing to become hotter than the required autoignition temperature. At these elevated temperatures, the casing has lower tensile strength which increases the probability of deformation during autoignition.

In some instances, additional devices are integrated into the inflation mechanism to inflate the restraint during a fire. However, some inflator components, for example initiators, are fabricated with materials that may deform or degrade at the high temperatures encountered during a fire. The deformed components may allow gases to leak and propel the activating unit into the passenger compartment following autoignition.

U.S. Pat. No. 5,380,380 to Poole et al. discloses an automobile occupant restraint system that will autoignite and cause ignition of a gas generant when heated to approximately 150°–210° C., thereby permitting use of an aluminum pressure vessel. The autoigniting composition contains a hydrazine salt of 3-nitro-1,2,4-triazole-5-one, boron, and potassium nitrate.

U.S. Pat. No. 5,084,118 to Poole discloses an autoigniting composition for the gas generator of a vehicle occupant restraint system that autoignites when heated to approximately 150°–210° C. The autoignition composition is made from sodium chlorate, 5-aminotetrazole, and 2,4-dinitrophenylhydrazine.

Published PCT application WO 95/04710 discloses a gas generant composed of phase-stabilized ammonium nitrate, a nitrogen containing fuel, and an optional organic polymer binder.

SUMMARY OF THE INVENTION

The invention features a low temperature autoigniting composition comprising a low temperature melting oxidizer and a fuel. The low temperature autoigniting composition autoignites in the temperature range of about 130° C. to about 175° C., preferably at temperatures less than 150° C., and most preferably in the temperature range of about 130° C. to about 150° C.

In a preferred embodiment, the invention features a low temperature autoigniting composition comprising a low temperature melting oxidizer, a fuel, and a catalyst, wherein the low temperature autoigniting composition autoignites in the temperature range of less than about 150° C. Preferably, the oxidizer comprises about 20 to about 70 percent by weight of the composition, the fuel comprises about 10 to about 50 percent by weight of the composition, and the catalyst comprises about 2 to about 50 percent by weight of the composition.

The low temperature melting oxidizer component of the invention may be any oxidizer or combination of oxidizers that melts between 130° C. and 175° C., preferably at less than 150° C., and most preferably in the range of 130° C. to 150° C. Preferred oxidizers include ammonium nitrate (AN), ammonium nitrate phase-stabilized with potassium nitrate (AN/KN), and the eutectic which ammonium nitrate forms with nitroguanidine (AN/NQ).

The fuel used in the composition of the invention preferably includes 3-nitro-1,2,4-triazol-5-one (NTO). Other fuels, such as semicarbizide hydrochloride, ethyl centralite, triazoles, tetrazoles, guanidine nitrate, aminoguanidine nitrate, triaminoguanidine nitrate, and hydrazinium nitrotriazolone may also be used. It is also possible to use oxidizer/fuel mixtures, such as the eutectic that ammonium nitrate forms with 3-nitro-1,2,4-triazol-5-one (AN/NTO).

The composition of the invention may also include other materials that help catalyze or accelerate decomposition after autoignition has occurred. Such materials include, but are not limited to, ammonium iodate ($NH_4IO_3$), carbon black, metals such as boron or copper, iron oxide and other metal oxides, or ammonium dichromate. A binder and/or processing aid may also be included in the composition of the invention to provide propellant pellet strength or as aid in processing by desensitizing the propellant for processing safety or to help in extruded propellant grain formation. Such materials include methyl cellulose, thermoplastic rubbers, starch, clay, talc, oxamide, or graphite.

Upon exposure to fire, the low temperature autoigniting composition of the invention autoignites before heat compromises the structural integrity of the mechanism casing to cause deformation or other structural damage. Accordingly, the lower temperature operation of the composition of the invention can prevent the casing of the airbag deployment mechanism from weakening and malfunctioning during ignition of the propellant.

DETAILED DESCRIPTION OF THE INVENTION

The invention is a low temperature autoigniting composition for a mobile occupant restraint system comprising a low temperature melting oxidizer and a fuel. The low temperature autoigniting composition autoignites in the temperature range of about 130° C. to about 175° C., preferably at less than 150° C., and most preferably in the temperature range of about 130° C. to about 150° C. The composition is designed to autoignite at temperatures which are lower than the autoignition temperatures of autoignition propellants currently available. A lower autoignition temperature allows for autoignition of the composition and inflation of the restraint system before sacrificing structural integrity of the mechanism casing during exposure to fire. Thus, during a fire, the lower temperature autoignition composition of the invention is activated before heat can affect the structural integrity of the mechanism casing and cause deformation or other structural damage. The lower temperature operation of the composition of the invention thus prevents the mechanism casing from weakening and rupturing during ignition of the propellant.

The composition of the invention includes low temperature melting oxidizers, such as ammonium nitrate (AN), ammonium nitrate phase-stabilized with potassium nitrate (AN/KN), or the eutectic which ammonium nitrate forms with nitroguanidine (NQ) in the propellant formulation. Oxidizer/fuel mixtures, such as the eutectic that ammonium nitrate forms with 3-nitro-1,2,4-triazol-5-one (AN/NTO) may also be implemented.

Preferably, the oxidizer comprises from about 20 to about 70 percent by weight of the total composition, and more preferably from about 30 to about 60 percent by weight of the total composition. Since ammonium nitrate melts at about 169° C., the AN/NQ eutectic melts at about 135° C., the AN/NTO eutectic melts at about 145° C., the oxidizer liquifies and become much more reactive in the lower temperature ranges. While not being bound by any particular theory, in the liquified state the oxidizer molecules become more physically mobile and reactive thus promoting increased interaction with the fuel and the catalyst and resulting in autoignition.

The fuel used in the composition of the invention is preferably 3-nitro-1,2,4-triazol-5-one (NTO). However, other fuels, such as semicarbizide hydrochloride, ethyl centralite, triazoles, tetrazoles, guanidine nitrate, aminoguanidine nitrate, triaminoguanidine nitrate, and hydrazinium nitrotriazolone may also be used. Preferably, the fuel comprises from about 10 to about 50 percent by weight of the total composition, and more preferably from about 20 to about 40 percent by weight of the total composition. Other fuels and oxidizers could be used in combination with AN and/or ammonium iodate to provide a larger enthalpy, better thermal stability during aging, or increased reactivity with the oxidizer.

A catalyst, such as ammonium iodate, carbon black, metals such as boron or copper, iron oxide and other metal oxides, or ammonium dichromate, is included to ignite the oxidizer and fuel composition after it has liquified. Preferably, the catalyst comprises from about 2 to about 50 percent by weight of the total composition, and more preferably from about 15 to about 35 percent by weight of the total composition. In one embodiment, an ammonium iodate catalyst is incorporated into a mixture of ammonium nitrate phase-stabilized with potassium nitrate (AN/KN), and 3-nitro-1,2,4-triazol-5-one (NTO) to form a low temperature autoignition mixture. As the composition is heated, the AN/KN and NTO combination liquifies at approximately 140° C. As heating continues, the ammonium iodate melts and becomes a reactive catalyst at 150° C. Thus, the oxidizer and fuel are in their most reactive state (i.e., the liquid state) when the catalyst becomes reactive enough to ignite the mixture and prompt combustion of the fuel in the propellant.

In order to mold the composition of the invention into useful forms, binders and/or processing aids may also be included in the composition of the invention. These materials permit formation of the propellant into pellet form, for example, during extrusion, or as an aid in processing by desensitizing the propellant during processing. Desensitization of the propellant is an important safety consideration during processing. Useful materials that function as binders or processing aids include methyl cellulose, thermoplastic rubbers, starch, clay, talc, oxamide, graphite, and the like. Preferably, this component comprises about 1% to about 15% by weight of the total composition.

Table I describes several exemplary autoignition compositions of the invention. All of the compositions in Table I meet the requirement of an autoignition temperature less than or equal to approximately 175° C. Several of these formulations are described in more detail below.

TABLE I

AUTOIGNITION COMPOSITIONS

| | Components, Weight % | | | | |
|---|---|---|---|---|---|
| Composition | AN/KN | NTO | Boron | $NH_4IO_3$ | Oxamide |
| 1 | 54 | 23 | | 23 | |
| 2 | 40 | 40 | 20 | | |
| 3 | 43.2 | 18.4 | 20 | 18.4 | |
| 4 | 36.4 | 36.4 | 18.2 | | 9 |
| 5 | 36 | 36 | 18 | | 10 |
| 6 | 32 | 32 | 16 | | 20 |
| 7 | 28 | 28 | 14 | | 30 |
| 8 | 56 | 24 | 20 | | |
| 9 | 63 | 27 | 10 | | |
| 10 | 40 | 30 | 30 | | |
| 11 | 63 | 10 | 27 | | |

The following examples are intended to illustrate the various aspects of the invention, but are not intended to limit the scope of the invention.

EXAMPLE I

Phase-stabilized ammonium nitrate (AN) may be prepared by heating a mixture of 85% AN and 15% potassium nitrate (KN) with enough water to dissolve all of the solid AN and KN when heated to about 80° C. The solution is stirred while cooling to room temperature. The resulting moist solid is spread out in a thin layer and dried in an oven at 80° C. After drying, the solid material is ground in a laboratory grinder to produce a fine granular powder of ammonium nitrate phase-stabilized with potassium nitrate (AN/KN). As shown in Table I, composition 1, the phase-stabilized ammonium nitrate, ammonium iodate, and 3-nitro-1,2,4-triazol-5-one (NTO) are combined in the following proportions:

| Component | Amount (wt %) |
|---|---|
| AN/KN | 54% |
| NTO | 23% |
| $NH_4IO_3$ | 23% |

These granular solids are blended and ground to a fine powder in a mortar and pestle. This material may be pressed into pellets by compression molding.

The propellant may be analyzed on a differential scanning calorimeter (DSC). The above composition is found to decompose exothermically at 148° C.

EXAMPLE II

As shown in Table I, composition 2, a mixture of phase-stabilized ammonium nitrate (AN/KN), NTO, and boron was prepared in the following proportions:

| Component | Amount (wt %) |
|---|---|
| AN/KN | 40% |
| NTO | 40% |
| Boron | 20% |

This composition is prepared by blending and grinding AN/KN prepared as in Example I with NTO and boron in the appropriate quantities in an agate mortar and pestle. The resulting powder may be pressed into pellets by compression molding.

This propellant is found to decompose exothermically at approximately 166° C., and has a Drop Weight Sensitivity (Bureau of Explosives Tester) of 29 kg.cm.

EXAMPLE III

As shown in Table I, composition 3, a mixture of phase-stabilized ammonium nitrate (AN/KN), NTO, ammonium iodate, and boron was prepared in the following proportions:

| Component | Amount (wt %) |
|---|---|
| AN/KN | 43.2% |
| NTO | 18.4% |
| Boron | 20% |
| $NH_4IO_3$ | 18.4% |

This propellant composition can be prepared by the methods described above. The propellant decomposes exothermically at approximately 130°–141° C.

EXAMPLE IV

In order to improve the impact sensitivity of the mixture of Example II, oxamide may be added as a processing aide. As shown in Table I, composition 4, the composition has the following components:

| Component | Amount (wt %) |
|---|---|
| AN/KN | 36.4% |
| NTO | 36.4% |

-continued

| Component | Amount (wt %) |
|---|---|
| Boron | 18.2% |
| Oxamide | 9.0% |

This propellant composition decomposes exothermically at approximately 150°–160° C. and has an enthalpy of reaction of approximately 1200 calories per gram. The addition of oxamide increases the impact sensitivity to approximately 90 kg.cm.

Although the invention has been shown and described with respect to illustrative embodiments thereof, it should be appreciated that the foregoing and various other changes, omissions and additions in the form and detail thereof may be made without departing from the spirit and scope of the invention as delineated in the claims.

What is claimed is:

1. A low temperature autoigniting composition comprising:

a low temperature melting oxidizer comprising from about 30% to about 60% by weight of said low temperature autoigniting composition; and a fuel comprising from about 10% to about 50% by weight of said low temperature autoigniting composition and selected from the group consisting of 3-nitro-1,2,4-triazol-5-one, semicarbizide hydrochloride, ethyl centralite, triazoles, tetrazoles, and triaminoguanidine nitrate;

wherein said low temperature melting oxidizer melts and autoignites said low temperature autoigniting composition in the temperature range from about 130° C. to about 150° C.

2. The low temperature autoigniting composition of claim 1, wherein said fuel comprises about 20 to about 40 percent by weight of said composition.

3. A low temperature autoigniting composition, comprising:

a low temperature melting oxidizer comprising from about 30% to about 60% by weight of said low temperature autoigniting composition; and a fuel comprising from about 10% to about 50% by weight of said low temperature autoigniting composition and selected from the group consisting of 3-nitro-1,2,4-triazol-5-one, semicarbizide hydrochloride, ethyl centralite, triazoles, tetrazoles, and triaminoguanidine nitrate; and a catalyst comprising from about 2% to about 50% by weight of said low temperature autoigniting composition;

wherein said low temperature melting oxidizer melts and autoignites said low temperature autoigniting composition in the temperature range from about 130° C. to about 150° C.

4. The low temperature autoigniting composition of claim 3, wherein said low temperature melting oxidizer is selected from the group consisting of ammonium nitrate, ammonium nitrate phase-stabilized with potassium nitrate, the eutectic which ammonium nitrate forms with nitroguanidine, and the eutectic that ammonium nitrate forms with 3-nitro-1,2,4-triazol-5-one.

5. The low temperature autoigniting composition of claim 3, wherein said catalyst is selected from the group consisting of ammonium iodate, carbon black, boron, copper, iron oxide, and ammonium dichromate.

6. The low temperature autoigniting composition of claim 3, wherein said oxidizer comprises about 30 to about 60 percent by weight of said composition, said fuel comprises about 20 to about 40 percent by weight of said composition, and said catalyst comprises about 15 to about 35 percent by weight of said composition.

7. The low temperature autoigniting composition of claim 3, further comprising a binder and/or processing aide.

8. The low temperature autoigniting composition of claim 7, wherein said binder and/or processing aide comprises from about 1 to about 15 percent by weight of said composition.

9. The low temperature autoigniting composition of claim 7, wherein said binder and/or processing aide is selected from the group consisting of methyl cellulose, thermoplastic rubber, starch, clay, talc, oxamide, and graphite.

* * * * *